US007234684B2

(12) United States Patent
Kohlenberg et al.

(10) Patent No.: US 7,234,684 B2
(45) Date of Patent: Jun. 26, 2007

(54) HOISTING DEVICE WITH LOAD MEASURING MECHANISM AND METHOD FOR DETERMINING THE LOAD OF HOISTING DEVICES

(75) Inventors: Thomas Kohlenberg, Paderborn (DE); Franz Schulte, Herdecke (DE)

(73) Assignee: Demag Cranes & Components GmbH, Wetter (DE)

( * ) Notice: Subject to any disclaimer, the term of this patent is extended or adjusted under 35 U.S.C. 154(b) by 136 days.

(21) Appl. No.: 10/908,713

(22) Filed: May 24, 2005

(65) Prior Publication Data

US 2005/0279976 A1 Dec. 22, 2005

(30) Foreign Application Priority Data

Jun. 3, 2004 (DE) ..... 10 2004 027 106

(51) Int. Cl.
*B66D 1/50* (2006.01)

(52) U.S. Cl. ..... 254/274

(58) Field of Classification Search ..... 254/274, 254/275

See application file for complete search history.

(56) References Cited

U.S. PATENT DOCUMENTS

| | | | | |
|---|---|---|---|---|
| 3,610,342 | A * | 10/1971 | Stainken | 177/147 |
| 3,867,678 | A * | 2/1975 | Stoner | 318/432 |
| 3,965,407 | A * | 6/1976 | Stoner | 318/432 |
| 4,048,547 | A | 9/1977 | Havard et al. | |
| 4,636,962 | A * | 1/1987 | Broyden et al. | 700/228 |
| 4,766,977 | A | 8/1988 | Yamasaki | |
| 6,048,276 | A * | 4/2000 | Vandergrift | 473/316 |
| 6,527,130 | B2 * | 3/2003 | Ruddy | 212/278 |
| 2002/0144968 | A1 * | 10/2002 | Ruddy | 212/278 |
| 2004/0099064 | A1 | 5/2004 | Viola et al. | |
| 2004/0144187 | A1 * | 7/2004 | Abele et al. | 73/866.5 |
| 2005/0034902 | A1 * | 2/2005 | Madhavarao | 177/136 |
| 2005/0167207 | A1 * | 8/2005 | Fujita et al. | 187/401 |

FOREIGN PATENT DOCUMENTS

| | | | |
|---|---|---|---|
| DE | 3537849 | C2 | 6/1987 |
| DE | 19512103 | C2 | 6/1997 |
| DE | 101 24 899 | A1 | 11/2002 |
| DE | 20300942 | U1 | 4/2003 |
| EP | 0 841 298 | A2 | 5/1998 |
| EP | 1 203 209 | A1 | 5/2002 |

OTHER PUBLICATIONS

European Search Report completed Sep. 23, 2005, from corresponding European Application No. EP 05 01 1161.

* cited by examiner

*Primary Examiner*—Emmanuel M Marcelo
(74) *Attorney, Agent, or Firm*—Van Dyke, Gardner, Linn & Burkhart, LLP

(57) ABSTRACT

A hoisting device, especially a cable or chain block, with a hoisting transmission having at least one shaft and with a hoisting load measuring mechanism. In order to determine the hoisting load as accurately as possible and possibly independent of the reeving and without additional structural height, the hoisting load has at least one sensor for detecting the deformation of the shaft produced by the hoisting load and the detected deformation is used as a quantity in determining the hoisting load.

17 Claims, 3 Drawing Sheets

4
15
7
19
19A
19B
18
18A
18B
17A
17B
17
17C
22
20
16
9
21
5

HOISTING DEVICE WITH LOAD MEASURING MECHANISM AND METHOD FOR DETERMINING THE LOAD OF HOISTING DEVICES

BACKGROUND OF THE INVENTION

The invention concerns a hoisting device, especially a cable or chain block, with a gearing having at least one shaft and with a load measuring mechanism.

Hoisting devices like cable or chain blocks have a predetermined lifetime, which depends on the load stress and the load frequency distribution. Furthermore, an economical use of hoisting devices requires a high capacity utilization. In order to determine the remaining lifetime each year, one therefore requires, at a minimum, the hours of operation and their load frequency distribution as data.

Formerly, the data needed to determine the hours of operation and the load frequency distribution were gathered manually or estimated. However, this is time-consuming and inaccurate. Methods and devices were therefore developed to automatically count the hours of operation, so-called operating hour counters. Corresponding methods and devices for monitoring of hoisting devices are known, for example, from DE 195 14 050 C2, DE 196 17 105 C2, DE 199 23 824 C2, DE 199 56 265 A1 and DE 40 38 981 A1.

The monitoring data are automatically gathered by means of these methods and with these devices, saved if so required, and put out via displays, wherein both the devices and the displays are usually arranged in the hoisting device. For this, it is known how to perform either a manual, optical reading of the displays or how to electronically read out the data by means of an interface and corresponding reading device.

Besides the hours of operation, the load frequency distributions are also kept track of. For this, one needs to determine the hoisting load.

But the hoisting load measurement is also useful to the safety, since the hoisting devices are designed for a maximum load, which must not be exceeded.

To avoid such overloading of the hoisting device, it is known, for example from DE 34 42 868 A1, how to employ end switches which shut off the hoisting device after exceeding a predetermined spring force corresponding to the maximum load. Although this ensures the safety of the hoisting device in operation, no direct measurement of the actual hoisting load is possible.

Therefore, for actual measurement of the hoisting load, one often uses load measuring mechanisms with measuring elements such as strain gauge strips, which enable a determination of the actual load in terms of the strain in the measurement strips. Furthermore, these are usually also combined with end switches.

The usual devices, however, have a number of drawbacks. They are costly and cumbersome. The strain gauge strips are usually not loaded directly by the full hoisting load, but instead are mechanically reduced, e.g., via suitable levers. But this leads to an increased physical size, especially the structural height. Moreover, only the force acting on the cable strand (or chain) is determined, but this is dependent on the reeving of the cable, so that this has to be factored into the absolute determination of the hoisting load. Also, no measurement without reeving is possible in these devices, since the measurement is done in the load string. On the whole, therefore, the usual devices involve a relatively elaborate evaluation of the signals and circumstances of the load measurement, requiring special electronics for the evaluation, in order to achieve the desired accuracy.

From German Utility Model DE 203 00 942 U1 is known a force transducer for the measuring of axle forces that essentially act transversely on an axle. Such a force transducer can be used, for example, to measure the forces acting on a cable drum, in order to prevent an overloading of the cable drum or the attached device. The force transducer essentially has a lengthwise extending axial body on a first segment for mounting of the cable drum, designated as the force entry zone. This first force entry segment is followed by two force measuring zones on either side, which have a smaller diameter than the force entry zone, as well as the bearing zones adjoining the force measuring zones. In the region of the bearing zones, the axle is mounted in appropriately configured cheeks. Within the force measuring zones there are blind boreholes oriented transversely to the lengthwise dimension of the axle, in which strain gauge strips are arranged. These blind boreholes are hermetically sealed at the outside with a cover, so that the force measuring system is protected against environmental influences. For reasons of redundancy, a blind borehole with strain gauge strips is arranged in each of the opposite force measuring zones in relation to the cable drum. The strain gauge strips can measure stresses, elongations, and shear forces of the material of the axle body in the region of the force measuring zone. The resulting measurement signals can then provide information as to the loading of the cable drum.

Moreover, from German Patent DE 195 12 103 C2 there is known a cable winch with an operating data gathering system. Besides a determination of the number of revolutions and direction of turning, the loading of the cable winch is also measured by torque sensors. This cable winch is essentially characterized by a cuplike pillow block at one side, serving to accommodate a hydraulic motor, and projecting into a cable drum of the winch. The output shaft of the hydraulic motor acts via a gearing on the cable drum of the winch. Torque sensors in the form of strain gauge strips are arranged at the outer circumference of the stationary cuplike pillow block, by which one can measure the loading of the cable winch as a function of the deformation of the pillow block.

Furthermore, from German Patent DE 35 17 849 there is known a torque sensor for a steering shaft or a transmission shaft of a motor vehicle. The shaft consists of a ferromagnetic material or a nonferromagnetic material that is covered with a film of ferromagnetic material. The torque sensor measures without contact the torque exerted on the shaft by sensing the magnetic permeability of the shaft. For this, the torque sensor has an excitation winding unit with two excitation coils and a sensor winding unit with two sensor coils. Since the magnetic fluxes of the excitation coils operated by alternating current pass through the shaft, the electrical signals generated in the sensor coils are dependent on the magnetic permeability of the shaft and, thus, on the torque exerted on the shaft.

SUMMARY OF THE INVENTION

The invention is directed to providing a hoisting device with a load measuring mechanism and a method for determining the hoisting load of hoisting devices in which the load determination occurs as accurately and structurally simple as possible. Furthermore, the structural embodiment should require little or no space. Also, the load measuring mechanism should be reliable and cost-favorable. Moreover, a measurement without reeving or independent of the reeving should be possible.

Because the load measuring mechanism has at least one sensor for detecting the deformation of the shaft caused by the hoisting load and the deformation detected is used as a quantity in determining the hoisting load, one can determine the hoisting load with special precision. The shaft on which the measurement occurs could also be arranged on the hoisting drum or other structural parts deformed by the hoisting load. The gear transmission, however, is especially attractive, since the shafts have a slight material thickness there, which heightens the speed and accuracy of the measurement. Moreover, no additional space is required for the measuring device inside the gear transmission, and furthermore the device is protected. Additionally, with the load measuring device of the invention, it is possible to measure directly with the hook on the cable, i.e., without reeving, since the measurement does not have to be situated at the cable fastening point.

Furthermore, the invention enables a cost-favorable production of the measuring device by eliminating the usual lever mechanism. Furthermore, the device is free of wear, since no contact need occur between the components and the moving parts. Not least, the invention enables far-reaching insight into the statics and kinematics of the hoisting device by interpretation of the measurement signal and enables far-reaching possibilities of monitoring the hoisting device.

The deformation can be, in a particular embodiment, the torsion of the shaft, since this type of deformation is the main component occurring in the loading of the shaft with the lifting load.

The invention relies on the knowledge that the shaft in the loaded state has a tendency to become deformed, i.e., to essentially twist or turn. This angular deviation about the lengthwise or axial axis of the shaft can be determined and used as a measure of the acting force.

Ideally, the torque transmitted by the individual gear shafts depends only on the load hanging from the hook, besides the fixed geometrical quantities. But this applies only to the static or uniformly moving case. In contrast, when the motion is accelerated, this must be considered in the generating of the torque on the cable drum. Likewise, one must account for the work ratio factors dependent on friction (such as cable rigidity and bearing friction) in the different directions of turning by using appropriate signs.

The torque transmitted deforms the shaft in accordance with its geometry and the material properties. The deformation of the shaft and especially the torsion (in this case) therefore corresponds to the torque being transmitted.

The sensors for detecting the deformation, and especially the torsion, can directly or indirectly determine the angular deviation or torsion.

In an embodiment, sensors are used which determine the torque of the shaft, since these are known and available in large numbers. From the torque, one can calculate the angular deviation produced by the torsion.

The sensors may be the magnetostrictive type. For this, the region of the shaft surveyed by the sensor is provided with a permanent magnetization of particular orientation. The orientation may be in the longitudinal direction of the shaft. This magnetic field can be detected by the sensor, configured as a magnetic field sensor. Now, if the shaft is deformed or twisted under its loading, the magnetic field of the shaft is altered by its deformation and/or torsion. This effect is known as magnetostriction. This change can be detected by the sensor and thus the hoisting load can be determined by the deformation detected.

For this, the shaft may have at least one zone of permanent magnetization in the area opposite the sensor, the magnetization being oriented essentially longitudinally in the direction of the shaft axis and generating a magnetic field outside of the region, having a magnetic field component in the circumferential direction in relation to the shaft axis and being detected by the sensor. The permanent magnetization in the shaft is artificially generated.

In these sensors, the shaft may have first and second zones in the region opposite the sensor, arranged in ring fashion about the shaft axis, with the second zone positioned radially inward from the first zone, and one of the zones has a permanent magnetization, oriented longitudinally in the direction of the shaft axis, and the other zone provides a flux return path for the flux generated by the one zone, and the one zone generates a magnetic field external to the region, having a magnetic field component in a circumferential direction relative to the shaft axis.

Such magnetized shafts are known, for example, from EP 1 203 209 B1.

The above-described deformation of the shaft by the load being lifted or lowered produces, in turn, a change in the magnetic properties or a change in the shape of the magnetic field in the shaft proportional to the deformation, thanks to magnetostrictive effects. This change in magnetic properties or change in shape of the magnetic field in the shaft can be detected by means of a sensor, which has, for example, one or more special coils arranged coaxially and symmetrically at equal distance. The change in the magnetic properties is thus detected by the sensor or coil and transformed into an electrical signal. A corresponding electronics processes and evaluates the signal. Instead of coils, the sensor can also have other suitable detectors sensitive to a magnetic field, such as semiconductor sensors operating on the principle of the Hall effect, resistance sensors, Wiegand and impulse wires, or Reed switches.

The sensors may have noncontact operation, so that wear and tear and disturbances from impurities are minimized.

One embodiment of the sensor on the shaft calls for a holder at least partly embracing the shaft. Thus, e.g., two detectors or coils sensitive to magnetic field can be arranged on opposite sides of the shaft, so that two measurement signals are produced, allowing for a more accurate measurement and possibly correction of the signals from environmental influences.

More precise and reliable results may be obtained when 2 to 8, especially 2, 4 or 8 detectors or coils sensitive to magnetic field are provided for each region and uniformly arranged about the region. Then, in particular, a redundant connection of the sensor or coils and evaluation of their signals can also be performed.

The holder can be secured inside and/or on the housing of the transmission.

The shaft of the transmission with the smallest diameter may be used for the measurement.

A signal processing unit according to an embodiment of the invention is provided to process the raw signals of the sensors. This can be a separate device. However, the electronics present in the controls of the hoisting device, such as microprocessors, etc., may be used for the evaluation. This saves on additional parts, which is desirable for reasons of maintenance, simplicity of construction and design, and less susceptibility to malfunction.

Additional features, benefits and details of the invention will follow from the description of the drawing below.

DESCRIPTION OF THE PREFERRED EMBODIMENT

Figure 1:
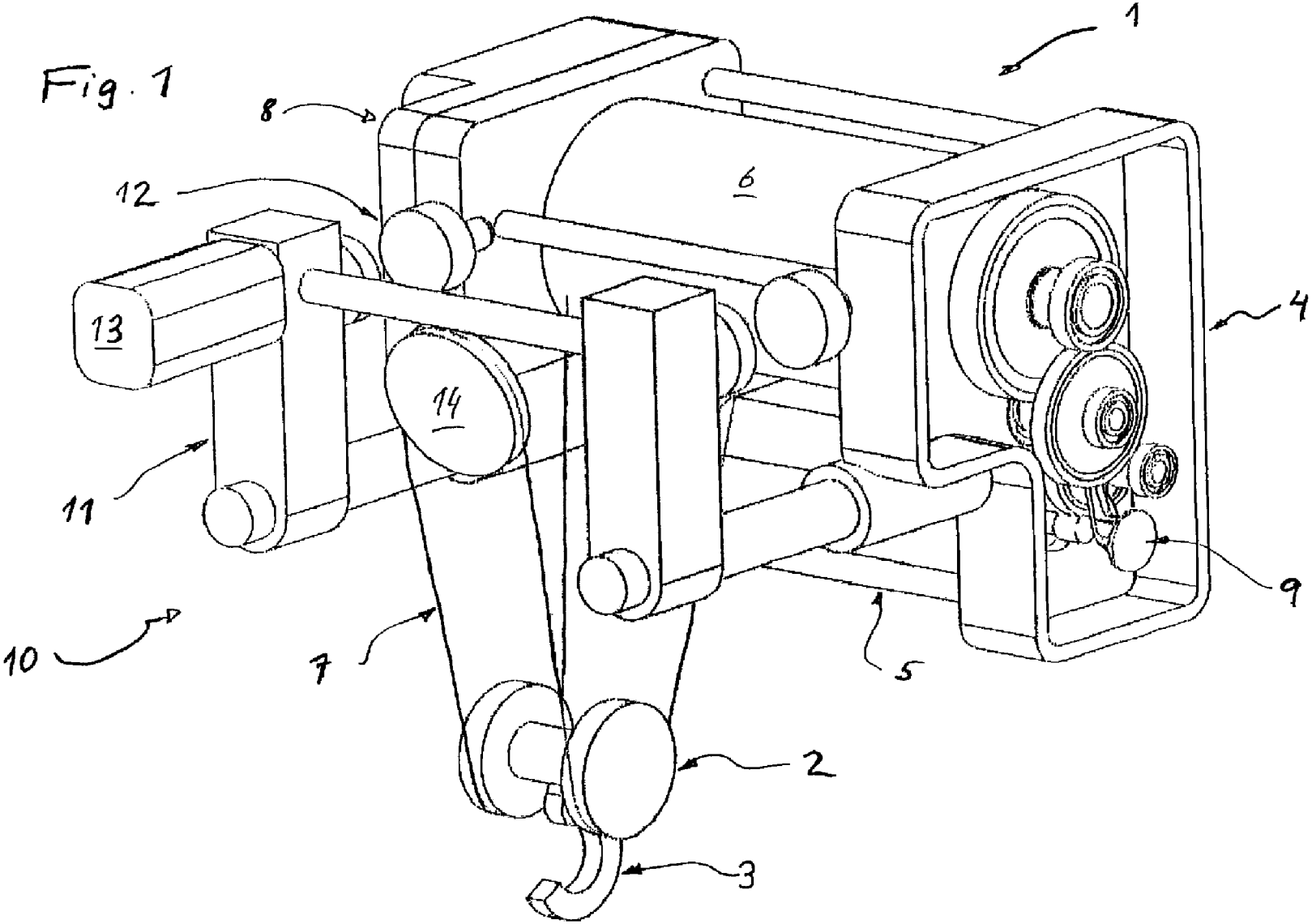
FIG. 1 is a perspective view of a single-rail trolley with lifting mechanism and load hook, the transmission housing being open to reveal internal details.

FIG. 1 shows a single-rail trolley, designated overall as 10, with a frame 11 and a hoisting mechanism 1 secured to it. For travel on the lower flange of a rail (not shown), the single-rail trolley 10 has four rollers 12, which lie opposite each other in pairs, one of them being driven by a motor 13.

A hoisting mechanism 1 is provided that includes a cable drum 6, driven by a motor 5 across a transmission 4, the transmission 4 being arranged on one side of the cable drum 6 and electronic controls 8 on the opposite side. The transmission 4 comprises a load measuring sensor 9 on one of its intermediate shafts.

A cable 7 is wound around the drum 6, being led across a deflection roller 14 and a bottom block 2 with hook 3. A load suspended from the hook 3 is raised and lowered by winding and unwinding the cable 7 on the drum 6 by corresponding controls of the motor 5.

Thus, depending on the particular static and kinematic relations and the reeving used, as well as the geometrical dimensions, the load hanging from the hook 3 produces a torque on the cable drum 6. This torque is transmitted by the transmission 4 with the corresponding ratios of the intermediate shafts to the motor 5. If the motor 5 produces the same moment, the load will be held in place. If the motor produces a larger moment, the load is lifted. If the motor produces a smaller moment, the load is lowered accordingly.

Figure 2:
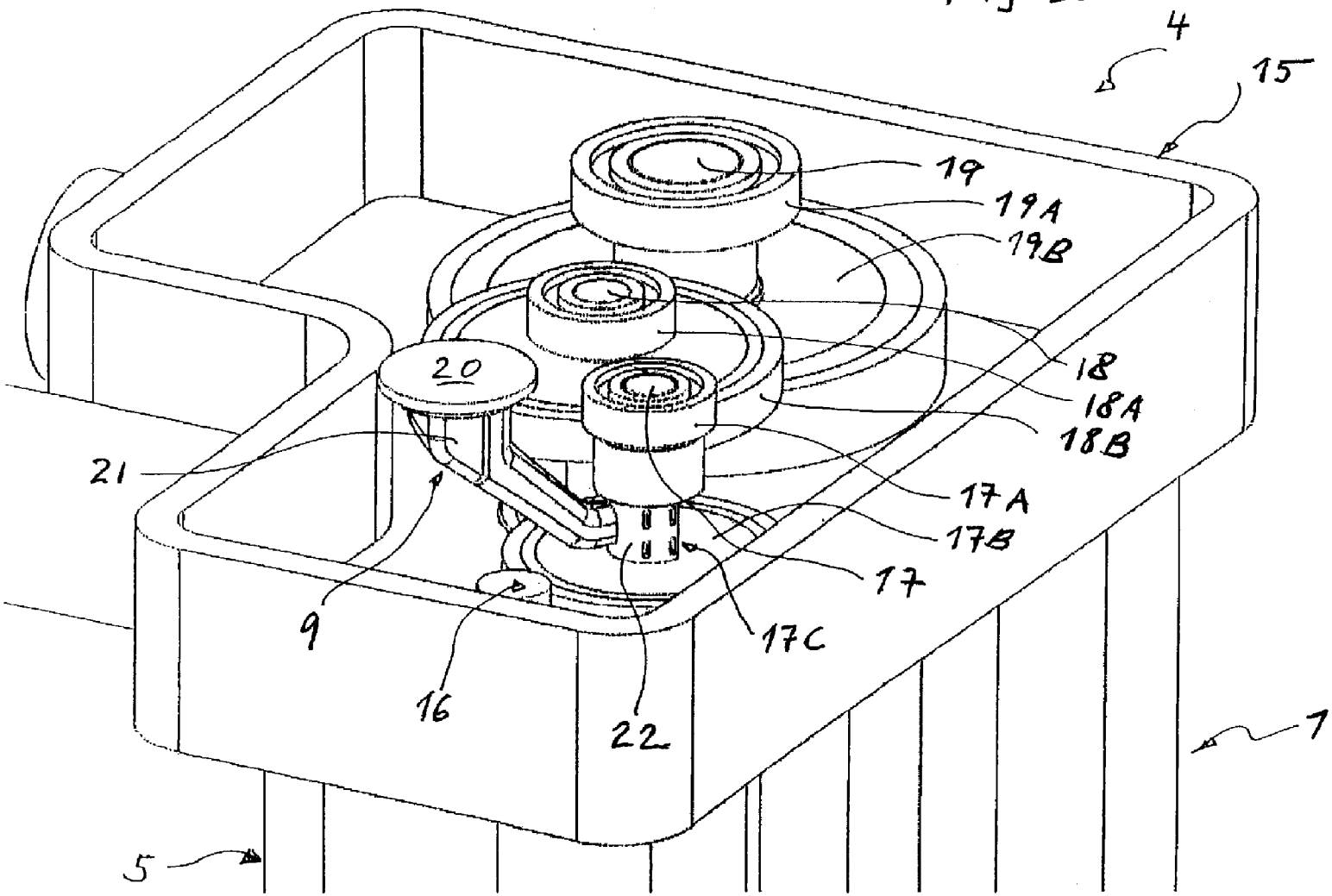
FIG. 2 is a magnified view of the transmission from FIG. 1 with the housing open.

FIG. 2 shows the transmission 4 of the hoisting mechanism 1 in a magnified view with the housing 15 opened. The motor 5 actuates, across a corresponding motor pinion 16, an intermediate shaft 17 and another intermediate shaft 18, an output shaft 19 and, thereby, the cable drum 6. The particular shafts 17, 18 and 19 each have a bearing designated by the suffix "A" and a gear designated by the suffix "B". The gears serve to transmit the rotary motion from one shaft to the next.

The sensor 9 is arranged on the intermediate shaft 17. The sensor 9 comprises a circular mount 20, to which an angled arm 21 is attached, passing into a holder 22. By the mount 20, the sensor 9 is attached to the housing cover (not shown).

The U-shaped holder 22 partly surrounds the intermediate shaft 17, which in this region 17C has a permanent magnetization oriented longitudinally in the direction of the shaft axis. Sensor coils as magnetic field-sensitive detectors are arranged in the holder 22 of the sensor 9. The sensor coils at least partly surround the intermediate shaft 17.

Figure 3:
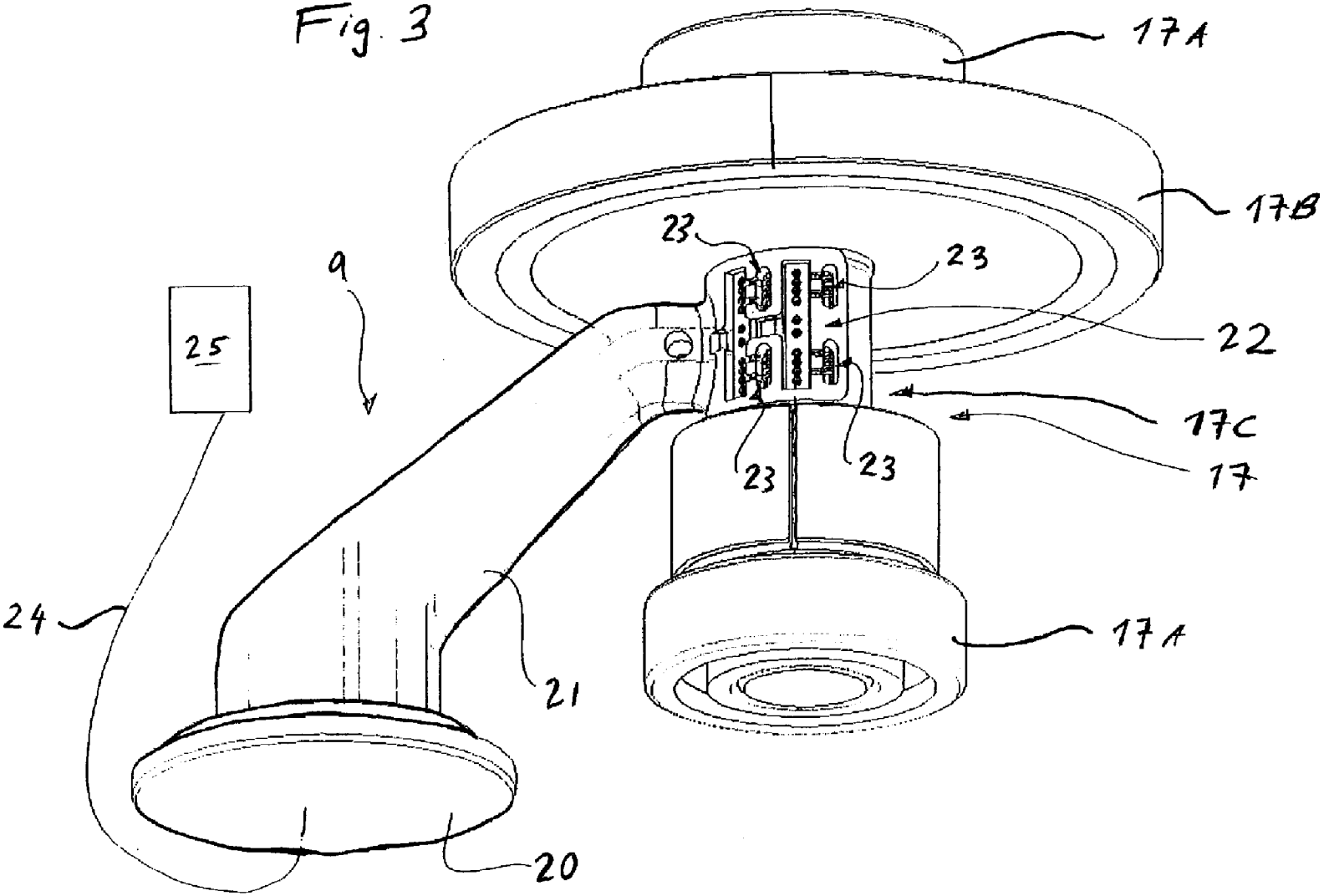
FIG. 3 is a perspective view of a transmission intermediate shaft with torque sensor from FIG. 2.

The intermediate shaft 17 with the sensor 9 is shown more clearly in FIG. 3. The holder 22 of the sensor 9 contains coils 23. These coils 23 are the actual magnetic field detectors and are each arranged in the holder 22 surrounding the region of permanent magnetization 17C of the intermediate shaft 17. In the sample embodiment depicted, there are eight coils 23, four coils each arranged on either side of region 17C, and being divided in turn into two pairs each. The coils 23 are wired redundant to each other and their signals are taken by a line 24 to a signal processing unit 25. This can be accommodated or integrated in the hoisting mechanism's electronics 8, for example.

The permanent magnetization of the region 17C of the intermediate shaft 17 or its magnetic field or the change in its orientation can be measured outside of the shaft with these special highly sensitive coils 23 and the corresponding circuit.

Ideally, the torque transmitted by the individual transmission shafts depends only on the load hanging from the hook 3, besides the fixed geometrical quantities.

However, this applies only to the static or uniformly moving case. In contrast, when the motion is accelerating, this must be considered for the torque generated on the cable drum 6. Likewise, the work ratio factors caused by friction (such as cable rigidity and bearing friction) must be considered by proper sign in the different directions of rotation. Depending on the desired accuracy and the circumstances, these parameters will be factored in by the signal processing unit 25.

Thus, when determining the hoisting load by deformation of the transmission intermediate shaft 17 under load, it is possible to factor in the torsion, bending, and tension/compression deformation. One can use here the number, arrangement and switching, as well as the type of evaluation of the sensors or coils 23. When determining the torsion of the shaft 17, one will consider the material (modulus of elasticity, shear modulus and transverse contraction) and the geometry of the shaft. When determining the transmitted torque, furthermore, the signal evaluation will involve the transmission ratio and efficiency, allowing for the friction in bearings and gaskets and the gear tooth system, as well as the viscosity of the oil in the transmission 4. When determining the torque on the cable drum 6 itself, the evaluation further includes the friction, e.g., at the bearings of the cable drum 6, as well as the diameter of the drum. Finally, to calculate the hoisting load, additional parameters are considered, such as cable tensile force, reeving, cable geometry, statics, kinematics and work ratio factors (e.g., frictional losses of the cable rollers), as well as gravity acceleration.

Depending on the desired accuracy, one can omit to consider certain parameters. In particular, these are the bending and tension/compression deformation, the friction in bearings and gaskets and the gear tooth system, and also the change in oil viscosity in the transmission under temperature changes.

Changes and modifications in the specifically described embodiments can be carried out without departing from the principles of the invention which is intended to be limited only by the scope of the appended claims, as interpreted according to the principles of patent law including the doctrine of equivalents.

What is claimed is:

1. A hoisting device, comprising:

a hoisting transmission having shaft and a hoisting load measuring mechanism;

said hoisting load measuring mechanism having at least one sensor, said at least one sensor detecting deformation of the shaft produced by the hoisting load, wherein the detected deformation is used as a quantity in determining the hoisting load;

wherein said at least one sensor determines the torsion of the shaft;

wherein said at least one sensor for detecting the deformation of the shaft detects the torque;

wherein said at least one sensor comprises a magnetic field sensor;

wherein said at least one sensor works by magnetostriction;

wherein said at least one sensor detects deformation without contact; and wherein the shaft has at least one zone of permanent magnetization in a region situated opposite said at least one sensor, the magnetization being oriented essentially longitudinal in die direction of the shaft axis, and said at least one zone of permanent magnetization generates a magnetic field outside the region having a magnetic field component in a circumferential direction in relation to the shaft axis, wherein said magnetic held component is detected by said at least one sensor.

2. The hoisting device per claim 1, wherein the shaft has unit and second zones in said region situated opposite said at least one sensor, said first and second zones being arranged in rings about the shaft axis, said second zone being positioned radially inward from said first zone, while one of said first and second zones has a permanent magnetization, oriented longitudinally in the direction of the shaft axis, and the other of said first and second zones furnishes a return path for the flux generated by said one of said first and second zones, and said one of said first and second zones generates a magnetic field outside the region, having a magnetic field component in a circumferential direction relative to the shall axis, wherein said magnetic field component in is detected by the sensor.

3. The hoisting device per claim 2 including a holder at least partly embracing the shaft for arranging said at least one sensor on the shaft.

4. The hoisting device per claim 3, wherein said bolder is secured in or on a housing of the hoisting transmission.

5. The hoisting device per claim 4, wherein the shaft is the shaft of the hoisting transmission with the smallest diameter.

6. The hoisting device per claim 5 including 2 to 8 detectors sensitive to magnetic field for each region of said at least one sensor, said detectors being arranged in general uniformly about the region.

7. The hoisting device per claim 6, wherein said at least one sensor comprises multiple sensors that are hooked up in a redundant manner.

8. The hoisting device per claim 7 including a signal processing unit, said signal processing unit processing signals from said multiple sensors.

9. The hoisting device per claim 8, wherein said signal processing unit is included with electronic controls of the hoisting device.

10. The hoisting device per claim 6, wherein said detectors comprise coils.

11. The hoisting device per claim 1, wherein said at least one sensor comprises multiple sensors that are hooked up in a redundant manner.

12. The hoisting device per claim 1, including a signal processing unit, said signal processing unit processing a signal from said at least one sensor.

13. The hoisting device per claim 12, wherein said signal processing unit is included with electronic controls of the hoisting device.

14. The hoisting device per claim 1, wherein the hoisting device is one of a cable and a chain block.

15. A hoisting device, comprising:

a hoisting transmission having a shaft and a hoisting load measuring mechanism;

said hoisting load measuring mechanism having at least one sensor, said at least one sensor detecting deformation of the shaft produced by the hoisting load, wherein the detected deformation is used as a quantity in determining the hoisting load;

including a holder at least partly embracing the shaft for arranging said at least one sensor on the shaft.

16. The hoisting device per claim 15, wherein said holder is secured in or on a housing of the hoisting transmission.

17. The hoisting device per claim 16, wherein the shaft is the shaft of the hoisting transmission with the smallest diameter.

* * * * *

UNITED STATES PATENT AND TRADEMARK OFFICE

CERTIFICATE OF CORRECTION

PATENT NO. : 7,234,684 B2
APPLICATION NO. : 10/908713
DATED : June 26, 2007
INVENTOR(S) : Thomas Kohlenberg and Franz Schulte It is certified that error appears in the above-identified patent and that said Letters Patent is hereby corrected as shown below:

Column 6:
Claim 1, Line 55, insert --a-- before "shaft".

Column 7:
Claim 1, Line 8, "die" should be --the--.
Claim 1, Line 12, "held" should be --field--.
Claim 2, Line 15, "unit" should be --first--.
Claim 2, Line 26, "shall" should be --shaft--.
Claim 2, Line 27, delete "in" (after) "component".
Claim 2, Line 31, "bolder" should be --holder--.

Signed and Sealed this

Fifteenth Day of July, 2008

JON W. DUDAS
*Director of the United States Patent and Trademark Office*